US005247917A

United States Patent [19]

Hummel et al.

[11] Patent Number: 5,247,917

[45] Date of Patent: Sep. 28, 1993

[54] FUEL INJECTION PUMP FOR INTERNAL COMBUSTION ENGINES

[75] Inventors: Karsten Hummel, Beilstein-Schmidhausen; Karl Rapp; Hansjoerg Frey, both of Stuttgart, all of Fed. Rep. of Germany

[73] Assignee: Robert Bosch GmbH, Stuttgart, Fed. Rep. of Germany

[21] Appl. No.: 983,352

[22] Filed: Nov. 30, 1992

[30] Foreign Application Priority Data

Dec. 24, 1991 [DE] Fed. Rep. of Germany ..... 4143040

[51] Int. Cl.[5] ..... F02M 59/28

[52] U.S. Cl. ..... 123/364; 123/372; 123/495

[58] Field of Search ..... 123/364, 372, 500, 501, 123/503, 495

[56] References Cited

U.S. PATENT DOCUMENTS

| | | | |
|---|---|---|---|
| 4,208,998 | 6/1980 | Hofmann et al. | 123/364 |
| 4,512,305 | 4/1985 | Pitozzi | 123/364 |
| 4,737,085 | 4/1988 | Guntert et al. | 123/501 |
| 4,840,161 | 6/1989 | Eckell et al. | 123/495 |
| 4,842,497 | 6/1989 | Hafele et al. | 123/495 |
| 4,850,321 | 7/1989 | Brisbon et al. | 123/364 |
| 4,989,571 | 2/1991 | Güentert et al. | 123/495 |
| 4,995,362 | 2/1991 | Brighigna | 123/372 |
| 5,080,564 | 1/1992 | Kasahara | 123/364 |

FOREIGN PATENT DOCUMENTS

| | | | |
|---|---|---|---|
| 0178427 | 8/1985 | European Pat. Off. . | |
| 2149362 | 4/1977 | Fed. Rep. of Germany . | |
| 3730523 | 3/1989 | Fed. Rep. of Germany . | |
| 2038934 | 7/1980 | United Kingdom | 123/364 |

*Primary Examiner*—E. Rollins Cross
*Assistant Examiner*—Thomas Moulis
*Attorney, Agent, or Firm*—Edwin E. Greigg; Ronald E. Greigg

[57] ABSTRACT

A fuel injection pump for internal combustion engines with a plurality of pump elements in which the fuel injection quantity is varied via a governor rod, which is supported in a U-shaped guide rail; according to the invention, this guide rail is loaded in its middle region by at least one spring element, in order to prevent transverse vibration of the governor rod.

20 Claims, 1 Drawing Sheet

FUEL INJECTION PUMP FOR INTERNAL COMBUSTION ENGINES

BACKGROUND OF THE INVENTION

The invention is based on a fuel injection pump for internal combustion engines as defined hereinafter.

In a commonly-known fuel injection pump of this type (DE-PS 21 49362), the governor rod, for reasons of cost and finishing, is made from a sheet metal part which cooperates with the regulating sleeves to rotate the pump piston and is longitudinally displaceably guided in a U-shaped guide rail which in turn is supported at least by its ends in the pump housing. Tabs, bent by the legs of the U, fit over the governor rod to guide it. This type of governor rod and guide rail structure enables the governor rod to be held with low mass, and thus, even with many load changes and resultant adjustments of the governor rod, makes it possible to react quickly and precisely to these changes.

However, in fuel injection pumps having a relatively high number of cylinders, e.g., eight cylinders, such a relatively lightweight system runs the risk the danger that transverse vibration can occur which can lead to a derailing of the entire structural unit, including the governor rod and guide rails, which in extreme cases may result in breaking the governor rod or bending the guide rails. In any case, the speed control quality is negatively influenced in the event of transverse vibration.

OBJECT AND SUMMARY OF THE INVENTION

According to the invention, the fuel injection pump has an advantage over the prior art that by simple additional means transverse vibration and hence the aforementioned disadvantages can be avoided, or supressed. The guide rail is supported, freely suspended, in the vicinity of the pump housing by means of the spring element in the form of a relatively rigid spring.

In a preferred embodiment of the invention, only one spring element is provided, in which case this spring element, in regard to length and width of the guide rail, is arranged approximately in the middle. Because the guide rail is usually fastened on both its ends via suitable means, supporting it in the middle in this way is sufficient.

In a further advantageous embodiment of the invention, the spring element is embodied as a leaf spring and is connected to the guide rail. Such a connection is especially advantageous when installing and removing the structural unit formed by the guide rail and governor rod, because, especially in fuel injection pumps with a high number of cylinders, access to the longitudinal bore in the inner region of the structure is restricted.

In a further advantageous embodiment of the invention in the areas of the guide rail and spring element that touch one another, hooks are provided on one (that is, either the guide rail or the spring element), while openings into which the hooks can be latched are provided on the other (that is, the spring element or the guide rail). By means of varying the location or shape of the leaf spring, these hooks can be pushed into the openings so that upon resumption of the original spring shape, the hooks engage the opening, in whichever part has them, from behind. Additionally, such a connection is not sensitive to jarring, because no parts that come loose are present. Furthermore, this connection is extremely economical and easy to assemble.

In another advantageous embodiment of the invention, transversely to the longitudinal extension, the leaf spring has three convex curvatures and within those, two concave curvatures; in a further exemplary embodiment of the invention the spring element is configured longitudinally symetrically, with a convex middle section which points away from the guide rails and with concave base parts adjoining the middle section in the direction of the longitudinal guide rail extension and resting on the guide rail; hooks provided on the guide rail are located in openings in these base parts. These base parts of the leaf spring become freely protruding convex bow springs, supported in the interior wall of the longitudinal bore. According to the invention, the convex/concave-shaped leaf spring can sometimes be variously shaped, in which case, for example, the section between the spring base part and the ensuing freely protruding bow spring encloses an angle to the guide rail of approximately 35 ∧ N°. The special embodiment of this leaf spring serves, on the one hand, to adapt to the wall of the longitudinal bore of the pump housing and, on the other hand, allows simple installation. The primary spring action is thereby taken over by the freely protruding bow springs, in which case, above all, the spring base part provides for a good contact with the guide rail.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
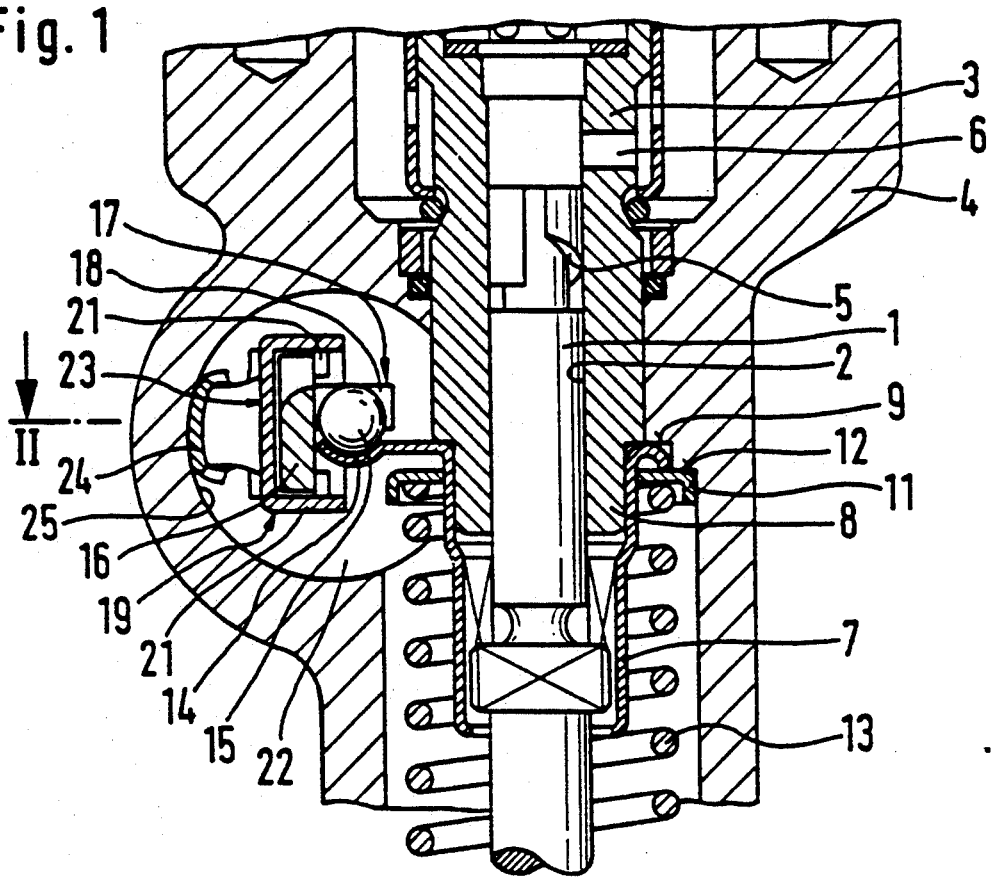
FIG. 1 is a detail of a fuel injection pump that shows a vertical section, in the vicinity of a pump element as well as a cross section taken along the line I—I in FIG. 2 through the governor rod and guide rail.

In the fuel injection pump of which only part is shown in a vertical section in FIG. 1, a pump piston 1 operates in the cylinder bore 2 of a pump cylinder 3 and is driven to reciprocate by a camshaft, not shown; the camshaft drives a number of further pump elements comprising pump pistons and pump cylinders, which are arranged in line with the element shown in the housing 4 of the fuel injection pump. On the jacket face of the pump piston 1, there is a control groove with an oblique control edge 5, which cooperates with a diversion bore 6 in the pump cylinder 3, so that in a known manner, the effective delivery stroke of the pump piston 1, and thus the fuel injection quantity, can be varied by rotating the pump piston.

The pump piston 1 is rotatable by means of a regulating sleeve 7, which is rotatably guided on a lower guide segment 8 of the pump cylinder 3 and is held in its axial installed location between a shoulder 9 in the pump housing 4 and a spring plate 11. A tappet spring 13 is supported by one end on the spring plate 11, which rests on a shoulder 12 of the pump housing 4, and with its other end, in a known manner not shown in further detail, loads a tappet of the pump piston 1 in the direction of the camshaft.

A steering arm 14 on which a ball 15 is fastened (soldered) is disposed on the regulating sleeve 7. The steering arm 14 and ball 15 form a coupling element for connection to a governor rod 16 with driver tabs 17 bent at a right angle to the pump piston axis, each of which has a slit-like recess 18 open to each ball 15. The recesses 18 have a width corresponding to the diameter of the ball, so that the ball is guided largely without play in the adjusting direction of the governor rod 16.

The governor rod 16 is axially displaceably supported in a guide rail 19 by its portions not angled toward the driver tabs. The guide rail 19 has a U-shaped cross section corresponding to the width of the governor rod 16, and guide tabs 21 are bent inward from U-shaped sides so as fit partway around the governor rod 16 and secure it against twisting. By means not shown, the guide rail 19 is supported on its ends in the pump housing and is generally accommodated in a longitudinal bore 22 in the pump housing, which serves in a known manner to receive the governor rod and through which fuel flows. The governor rod itself is actuated in a known manner via a speed governor located on the governor end of the pump housing.

Figure 2:
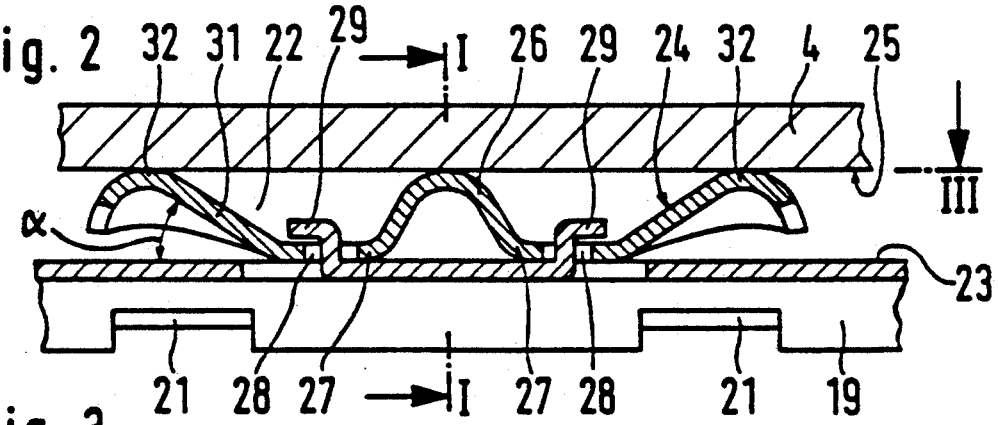
FIG. 2 is a detail of the guide rail and housing in a section taken along line II—II in FIG. 1 and FIG. 3.
Figure 3:
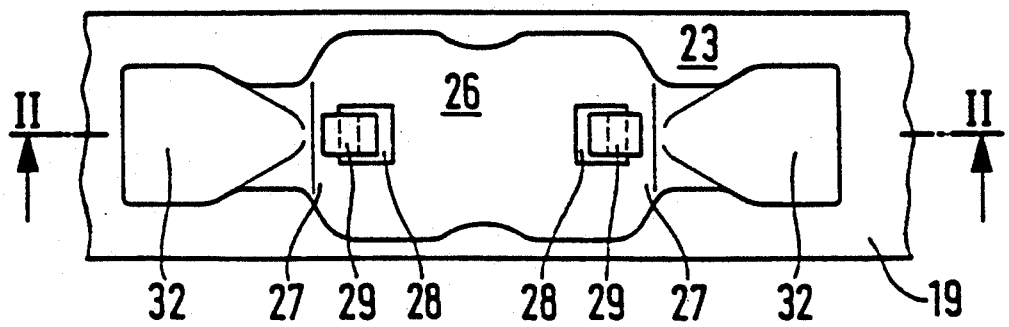
FIG. 3 is a view as indicated by the arrow III in FIG. 2.

A leaf spring element 24 on its side 23 remote from the pump piston is connected to a guide rail 19 and rests with its back side on the inner surface 23 of the longitudinal bore 22. As shown in the longitudinal section through the leaf spring element 24 in FIG. 2, this element has three convex and two concave curvatures, as viewed from the guide rail 19; the concave curvatures are in contact with the guide rail 19, while the convex curvatures are in contact with the inner surface 25 of the longitudinal bore 22. The middle convex curvature, as a spring center part 26, changes on the right and left to become the somewhat flattened concave curvatures serving as spring base elements 27, with which the leaf spring element 24 rest on the side 23 of the guide rail 19. Openings 28 which are engaged by hooks 29 of the guide rail 19 are provided in the flattened portion of the spring base element 27; the hooks 29 are stamped out from the wall of the guide rail 19 and shaped. In this way, with only slight deformation, the leaf spring element 24 can be latched through its openings 28 via these hooks 29, so as to be connected with the guide rail with play. After an intermediate element 31, the spring base elements 27 become convex, freely protruding bow springs 32 again, which again rest on the inner surface 25 of the longitudinal bore 22, acting as a freely resilient element. The intermediate elements 31 form an angle o of approximately 30° with the side 23 of the guide rail 19. As can be seen in FIGS. 1 to 3, at the transitions to the bearing surfaces, the leaf spring element 24 is spherically rounded. Additionally, the free bow springs are embodied more narrowly than the spring base elements 27. In terms of its width, the spring center part 26 is in turn tapered relative to the spring base element 27.

In six-to eight cylinder fuel injection pumps, one such leaf spring element 24 for the guide rail 19 should be sufficient. According to the invention, however, a plurality of such leaf spring elements can also be used when needed, especially in fuel injection pumps with an even higher number of elements. The axially symmetrical design of the leaf spring element makes installation easier and makes for uniform tension. The play in the longitudinal direction that exists between the hooks 29 and edges of the openings 28 does not impair the elasticity of the leaf spring element. In the built-in state, the leaf spring element 24 absorbs transverse vibration of the governor rod 16, or of the guide rail 19, and thus prevents not only breakage of the governor rod or coupling of the pump element, but also prevents errors in control, which can originate in such superimposed transverse vibration of from seizing in between the governor rod and guide rail.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having a plurality of pump elements disposed in line in a pump housing (4) and driven by means of a camshaft of a pump piston (1), each pump element comprising—disposed coaxially to one another—a pump cylinder (3) and or a regulating sleeve (7), wherein an injection quantity is varied by rotating one of these parts, a governor rod (16) that is nonrotatable and axially displaceable in a guide rail (19), and which is coupled with the rotatable part (1,7) of the pump elements via projecting driver elements (17), a U- or C-shaped cross section of the guide rail (19), the freely projecting sides of which fit at least partway around the governor rod (16), leaving a slit for said driver tabs (17), and the guide rail (19) and governor rod (16) are disposed in longitudinal bore (22) parallel to the camshaft in the pump housing (4) and having the guide rail (19) secured to the ends of the bore, transversely to the longitudinal extension of the guide rail (19), at least one spring element (24) engages the guide rail (19) and rests on a back side on an inner face (25) of the longitudinal bore (22).

2. A fuel injection pump as defined by claim 1, in which only one spring element (24) is provided, and that said spring element is disposed approximately in a middle of the guide rail (19) in terms of length and width of the guide rail (19).

3. A fuel injection pump as defined by claim 1, in which the spring element (24) is embodied as a leaf spring and is connected to the guide rail (19).

4. A fuel injection pump as defined by claim 3, in which on a contacting point of the guide rail (19) and leaf spring (24), hooks (29) are present on the one and openings (28) into which the hooks (29) are latched are present on the other.

5. A fuel injection pump as defined by claim 3, in which transversely to the longitudinal extension and viewed from the guide rail (19) the leaf spring element (24) has three convex curvatures (26, 32), and between them, two concave curvatures (27).

6. A fuel injection pump as defined by claim 4, in which transversely to the longitudinal extension and viewed from the guide rail (19), the leaf spring element (24) has three convex curvatures (26, 32), and between them, two concave curvatures (27).

7. A fuel injection pump as defined by claim 5, in which the leaf spring element (24) is embodied as center-axially symmetrically in the longitudinal and widthwise direction, with a convex curved spring center part (26) and with concave spring base parts (27) adjoining the convex curved spring center part on both sides, in a direction of the guide rail extension, in which openings (28) for hooks (29) are provided on the guide rail (19) and that the spring base parts (27) of the leaf spring element (24) become convex freely projecting bow springs (32), which are supported on the inner face (25) of the longitudinal bore (22).

8. A fuel injection pump as defined by claim 6, in which the leaf spring element (24) is embodied a center-axially symmetrically in the longitudinal and widthwise direction, with a convex curved spring center part (26) and with concave spring base parts (27) adjoining the convex curved spring center part on both sides, in a direction of the guide rail extension, in which openings (28) for hooks (29) are provided on the guide rail (19) and that the spring base parts (27) of the leaf spring element (24) become convex freely projecting bow springs (32), which are supported on the inner face (25) of the longitudinal bore (22).

9. A fuel injection pump as defined by claim 7, in which the spring center part (26) of the leaf spring element (24) is additionally rounded in its transverse extension in the direction of the guide rail (19) and as a result is embodied as slightly reduced in width.

10. A fuel injection pump as defined by claim 8, in which the spring center part (26) of the leaf spring element (24) is additionally rounded in its transverse extension in the direction of the guide rail (19) and as a result is embodied as slightly reduced in width.

11. A fuel injection pump as defined by claim 7, in which the spring base parts of the leaf spring element (24) have a plane portion for receiving the openings (28) and for resting on the side (23) of the guide rail (19).

12. A fuel injection pump as defined by claim 9, in which the spring base parts of the leaf spring element (24) have a plane portion for receiving the openings (28) and for resting on the side (23) of the guide rail (19).

13. A fuel injection pump as defined by claim 7, in which the freely projecting bow springs (32) are embodied more narrowly than the spring base parts (27) and the spring center part (26) of the leaf spring element (24), and that they are spherically rounded on all sides.

14. A fuel injection pump as defined by claim 9, in which the freely projecting bow springs (32) are embodied more narrowly than the spring base parts (27) and the spring center part (26) of the leaf spring element (24), and that they are spherically rounded on all sides.

15. A fuel injection pump as defined by claim 11, in which the freely projecting bow springs (32) are embodied more narrowly than the spring base parts (27) and the spring center part (26) of the leaf spring element (24), and that they are spherically rounded on all sides.

16. A fuel injection pump as defined by claim 7, in which the intermediate spring parts (31) each form an angle ($\alpha$) of approximately 35° between the spring base part (27) and the freely-projecting bow spring (32) toward the guide rail (19).

17. A fuel injection pump as defined by claim 9, in which the intermediate spring parts (31) each form an angle ($\alpha$) of approximately 35° between the spring base part (27) and the freely-projecting bow spring (32) toward the guide rail (19).

18. A fuel injection pump as defined by claim 11, in which the intermediate spring parts (31) each form an angle ($\alpha$) of approximately 35° between the spring base part (27) and the freely-projecting bow spring (32) toward the guide rail (19).

19. A fuel injection pump as defined by claim 13, in which the intermediate spring parts (31) each form an angle ($\alpha$) of approximately 35° between the spring base part (27) and the freely-projecting bow spring (32) toward the guide rail (19).

20. A fuel injection pump as defined by claim 1, in which the spring element (24), on a side remote from the pump element (1, 3), acts upon the guide rail (19).

* * * * *